US006749539B2

(12) United States Patent
Hsieh

(10) Patent No.: US 6,749,539 B2
(45) Date of Patent: Jun. 15, 2004

(54) TRANSMISSION DEVICE FOR SWING EXERCISING DEVICE

(76) Inventor: Wen-Hsu Hsieh, No. 27, Lane 300, Tianshiang Rd., Changhua (TW)

( * ) Notice: Subject to any disclaimer, the term of this patent is extended or adjusted under 35 U.S.C. 154(b) by 117 days.

(21) Appl. No.: 10/177,356

(22) Filed: Jun. 24, 2002

(65) Prior Publication Data

US 2003/0236151 A1 Dec. 25, 2003

(51) Int. Cl.[7] ..... A63B 71/00

(52) U.S. Cl. ..... 482/51; 601/28; 601/29; 601/31; 601/32

(58) Field of Search ..... 601/28, 23, 27, 601/30, 31, 32, 35, 51, 85–87, 84, 89, 93, 99, 101; 482/79, 51

(56) References Cited

U.S. PATENT DOCUMENTS

| | | | | | |
|---|---|---|---|---|---|
| 5,372,563 | A | * | 12/1994 | Chien-Nan | 482/79 |
| 5,468,215 | A | * | 11/1995 | Park | 601/23 |
| 6,342,042 | B1 | * | 1/2002 | Martin | 601/93 |
| 6,511,447 | B1 | * | 1/2003 | Huang | 601/28 |
| 6,572,568 | B2 | * | 6/2003 | Huang | 601/28 |

* cited by examiner

*Primary Examiner*—Nicholas D. Lucchesi
*Assistant Examiner*—Tam Nguyen
(74) *Attorney, Agent, or Firm*—Charles E. Baxley

(57) ABSTRACT

A transmission device for a swing exercising device and includes two shafts respectively and eccentrically connected to two gears. One of the shafts pivotably connected to a support member and the other shaft is reciprocatingly retained in a slot of a frame in the support member.

3 Claims, 9 Drawing Sheets

TRANSMISSION DEVICE FOR SWING EXERCISING DEVICE

FIELD OF THE INVENTION

The present invention relates to a transmission device for a swing exercising device wherein the frame is driven in various ways of movement.

BACKGROUND OF THE INVENTION

A conventional swing exercising device generally includes a motor which drives a cam device and a frame having two recesses for two feet of a user to put in is driven by the cam device so that when the motor is operating, the frame is moved reciprocatingly and the feet of the user is exercised during the reciprocal movement. An inherent shortcoming of the conventional swing exercising device is that only one mold of movement of the frame is provided for the user and it is easily to feel boring during using the swing exercising device. The boring movement of the conventional swing exercising obviously cannot attract the users to use it.

The present invention intends to provide a transmission device for a swing exercising device that provides multiple ways of movement.

SUMMARY OF THE INVENTION

In accordance with one aspect of the present invention, there is provided a swing exercising device that includes a base having holes defined therethrough and two gears are pivotably connected to an outside of the base by extending shafts through the holes in the base and connected to gears eccentrically. A driving device has a driving gear engaged with the two gears and a frame with a support member is connected to the two shafts. The frame has a hole and a slot respectively defined therethrough and the two shafts are engaged with the hole and movably retained in the slot respectively.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
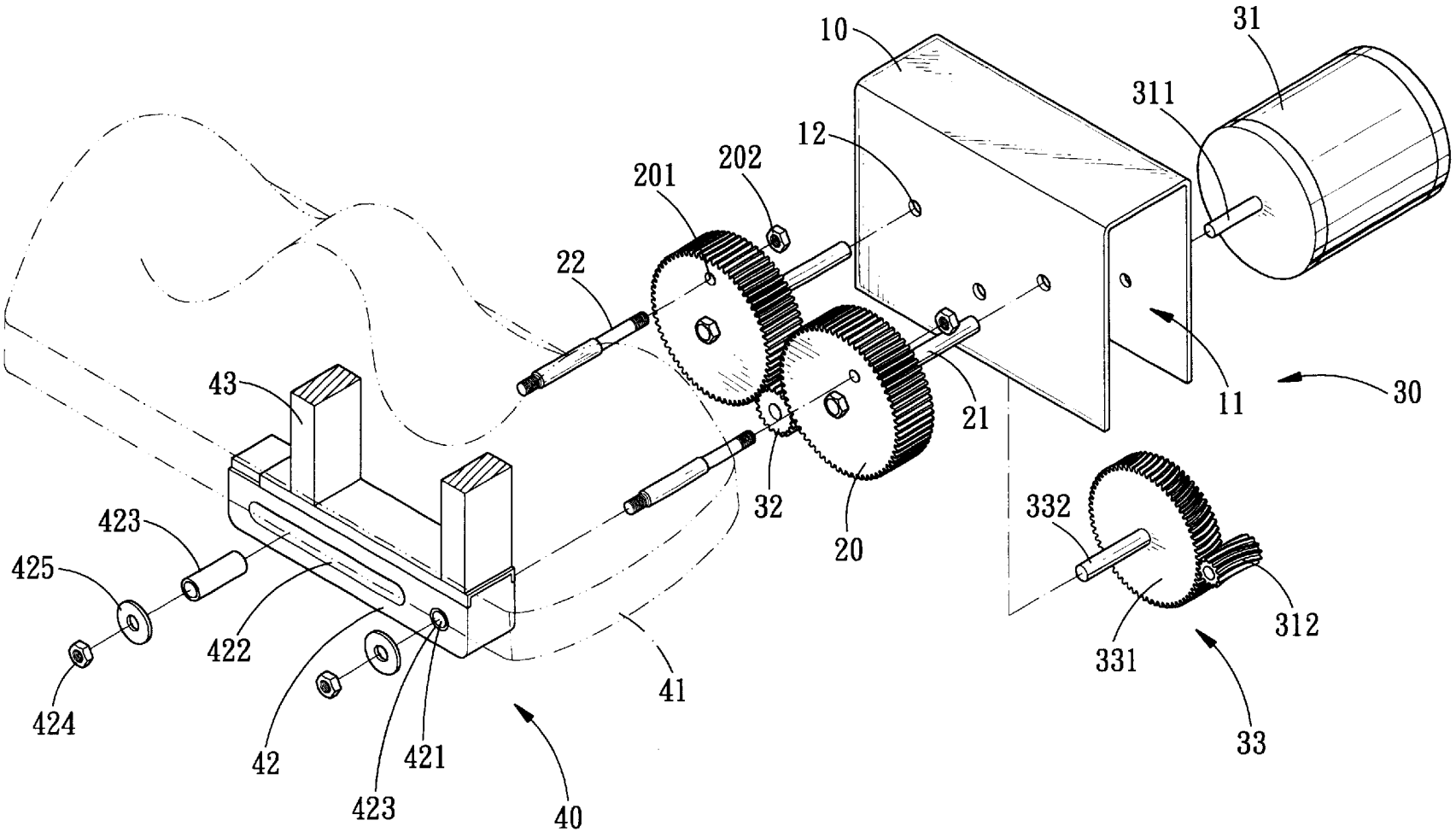
FIG. 1 is an exploded view to show the swing exercising device of the present invention.
Figure 2:
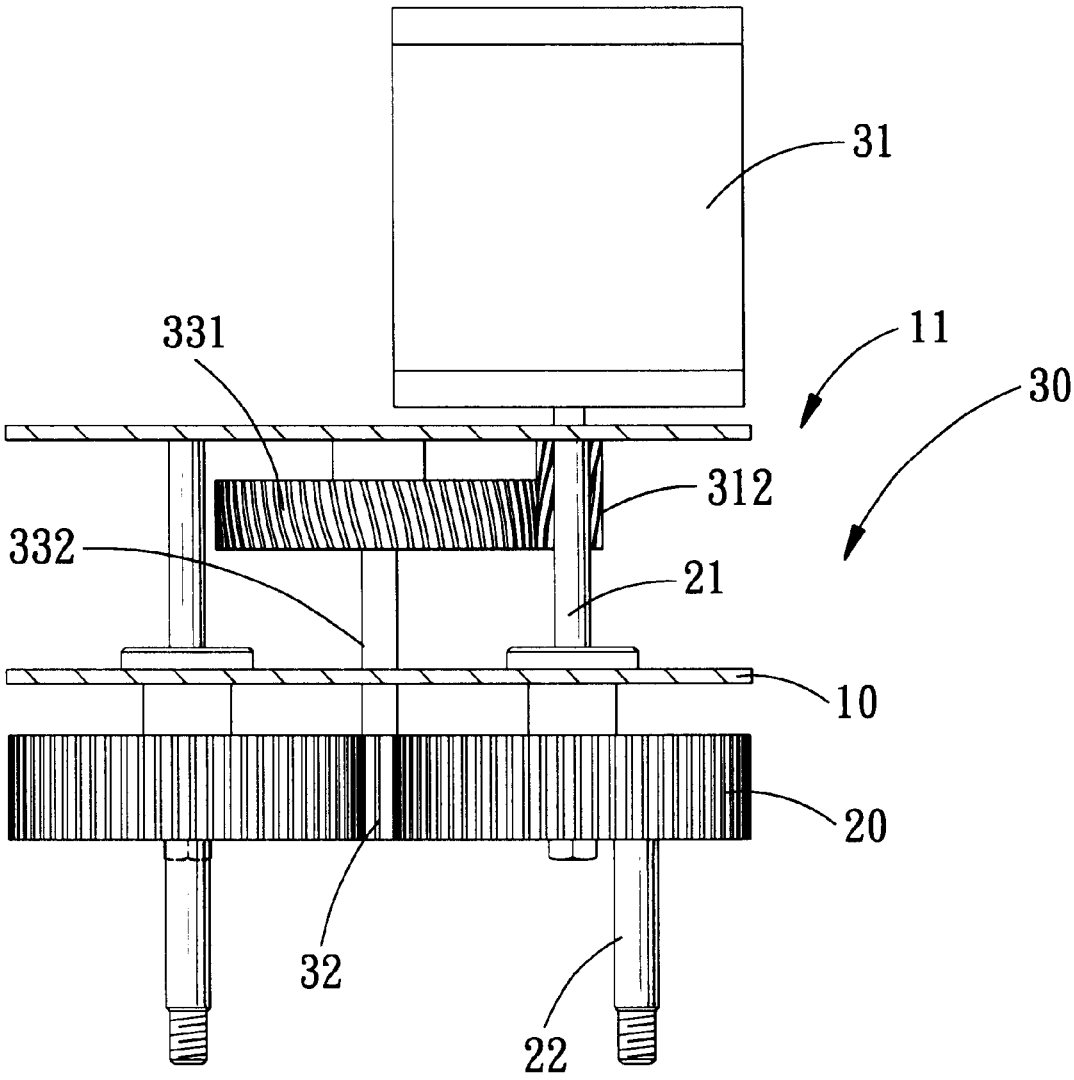
FIG. 2 shows the engagement of the gears of the driving device and the reduction device.
Figure 3:
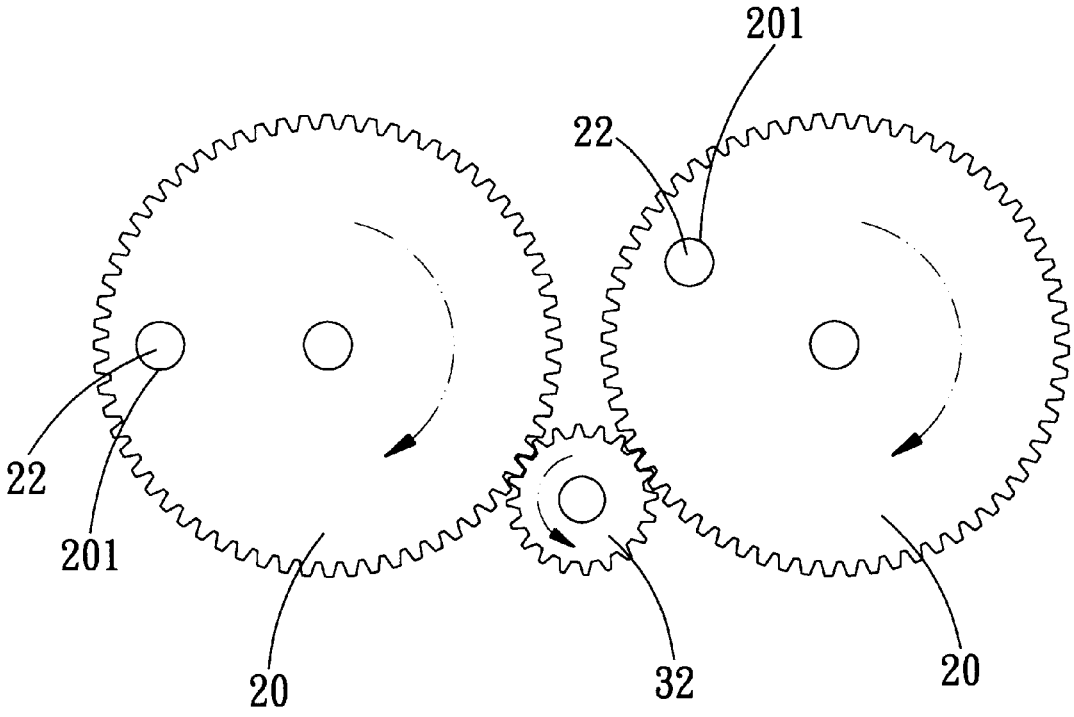
FIG. 3 shows the engagement of the driving gear and the two gears.
Figure 4:
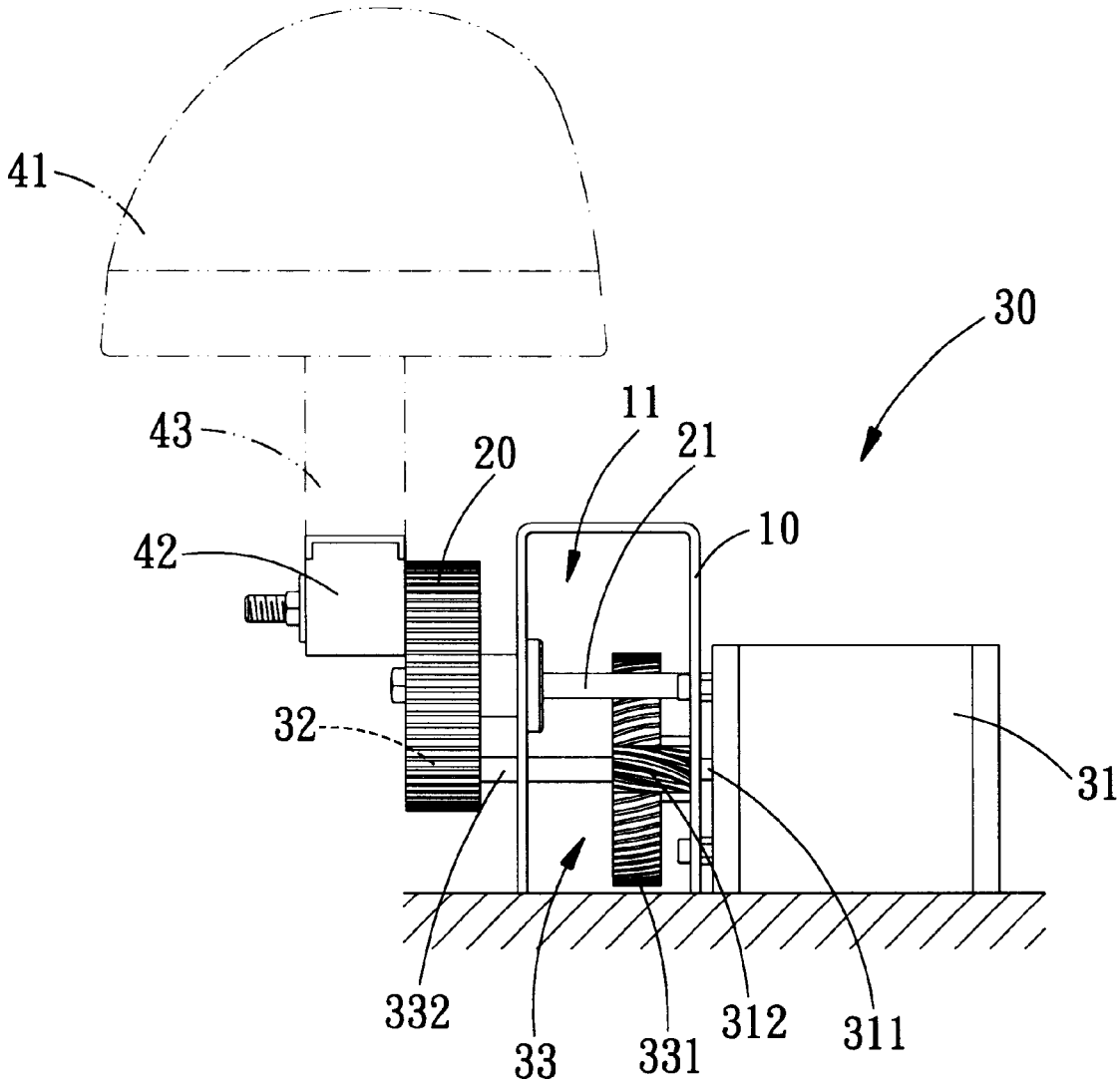
FIG. 4 is a side view to show the engagement of the gears of the driving device and the reduction device.

Referring to FIGS. 1 to 4, the swing exercising device of the present invention comprises a U-shaped base 10 which has holes 12 defined through two walls thereof and two gears 20 are pivotably connected to an outside of the base 10 by extending two rods 21 connected to a center of the two gears 20 through the holes 12. A driving device 30 includes a driving gear 32 which is engaged with the two gears 20.

A shaft 22 is connected to each gear 20 eccentrically at the hole 201 in each of the gears 20 by a nut 202. The driving gear 32 is driven by a reduction device 33 located in a space 11 between the two walls of the base 10. A motor 31 drives the reduction device 33 and has an output shaft 311 connected to a worm rod 312 which drives a reduction gear 331 and a shaft 332 extending from the reduction gear 331 that is connected to the driving gear 32. By reduction device 33, the rotational speed of the two gears 20 is reduced.

A swing assembly 40 includes a frame 42 having two rods 43 and a support member 41 is connected to the two rods 43. Two recesses are defined in a top of the support member 41 so that two feet of a user are put in the recesses. A hole 421 and a slot 422 are respectively defined in the frame 42. Two bushes 423 are respectively received in the hole 421 and the slot 422, and one of the two shafts 22 is engaged with the hole 421 and the other shaft 22 is movably retained in the slot 422. The two bushes 423 are mounted to the two shafts 22 and each shaft 22 is connected with a nut 424 and a washer 425.

Figure 5:
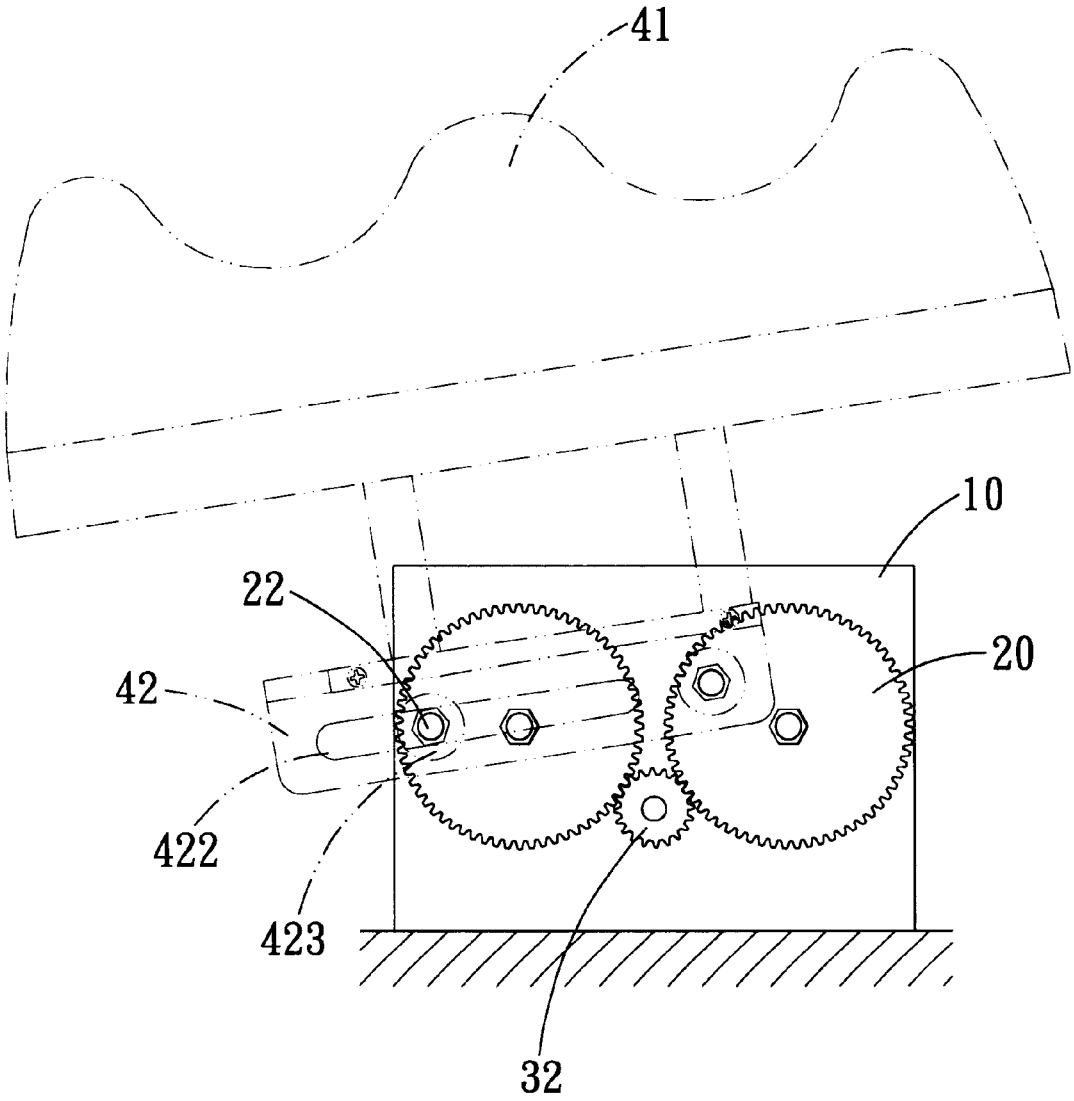
FIGS. 5 to 9 show different positions of the support member of the swing exercising device of the present invention.
Figure 6:
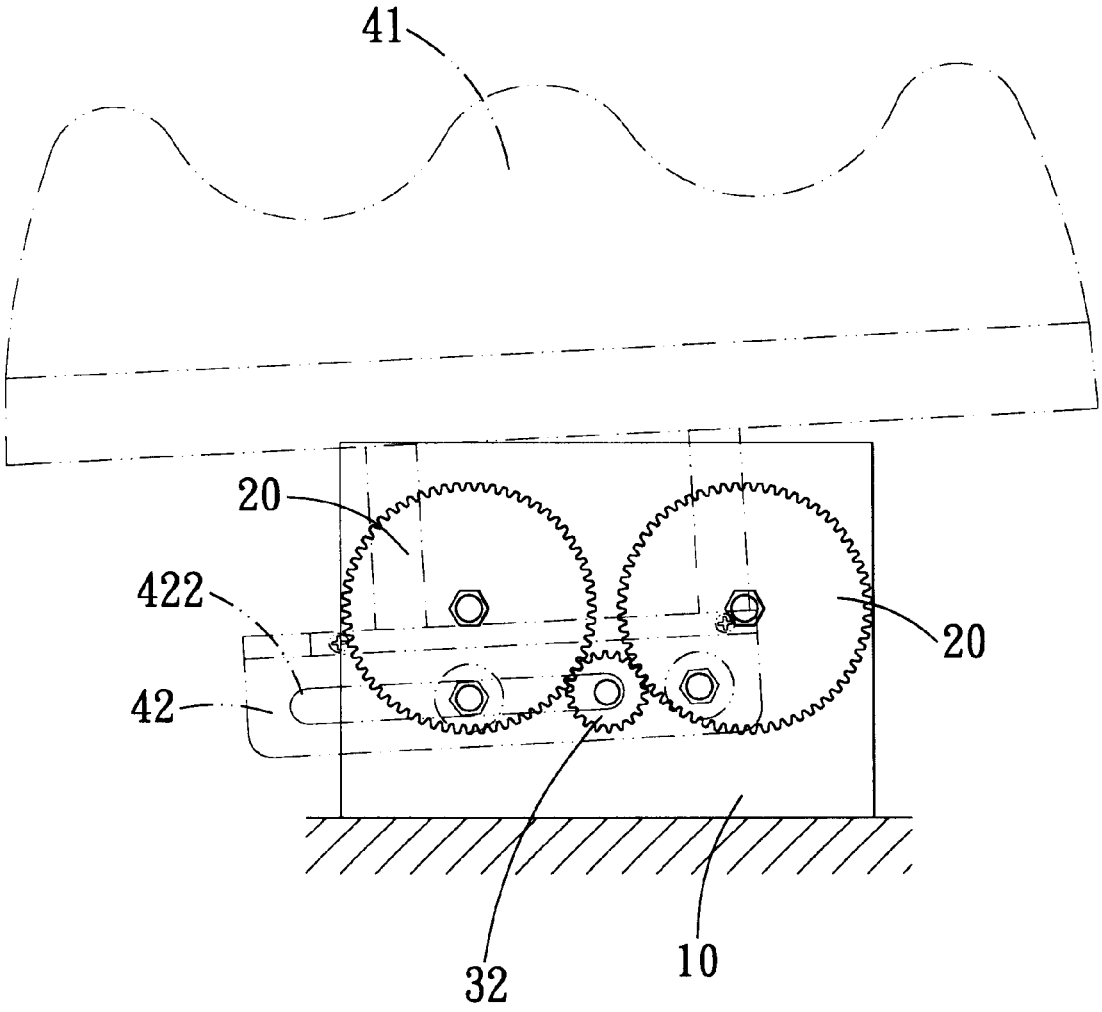
Figure 7:
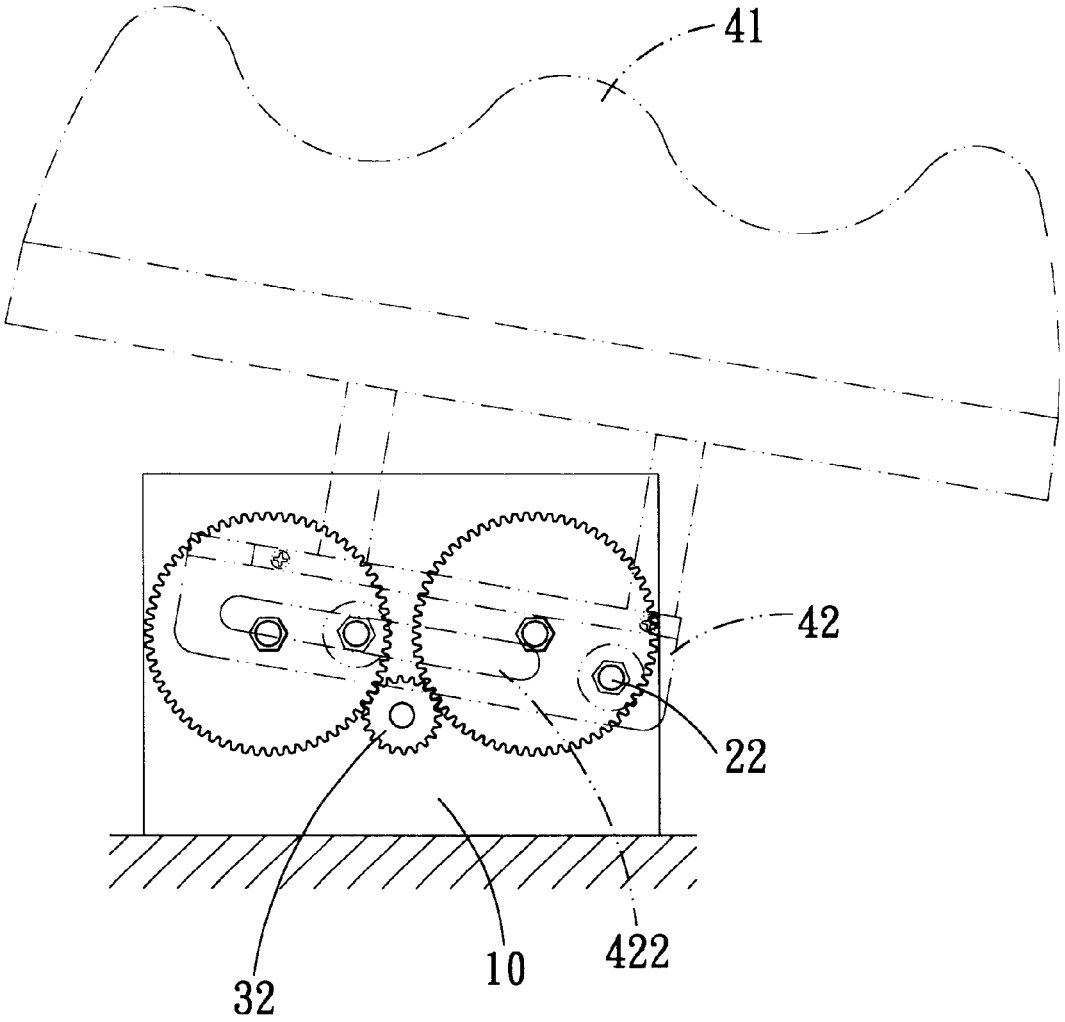
Figure 8:
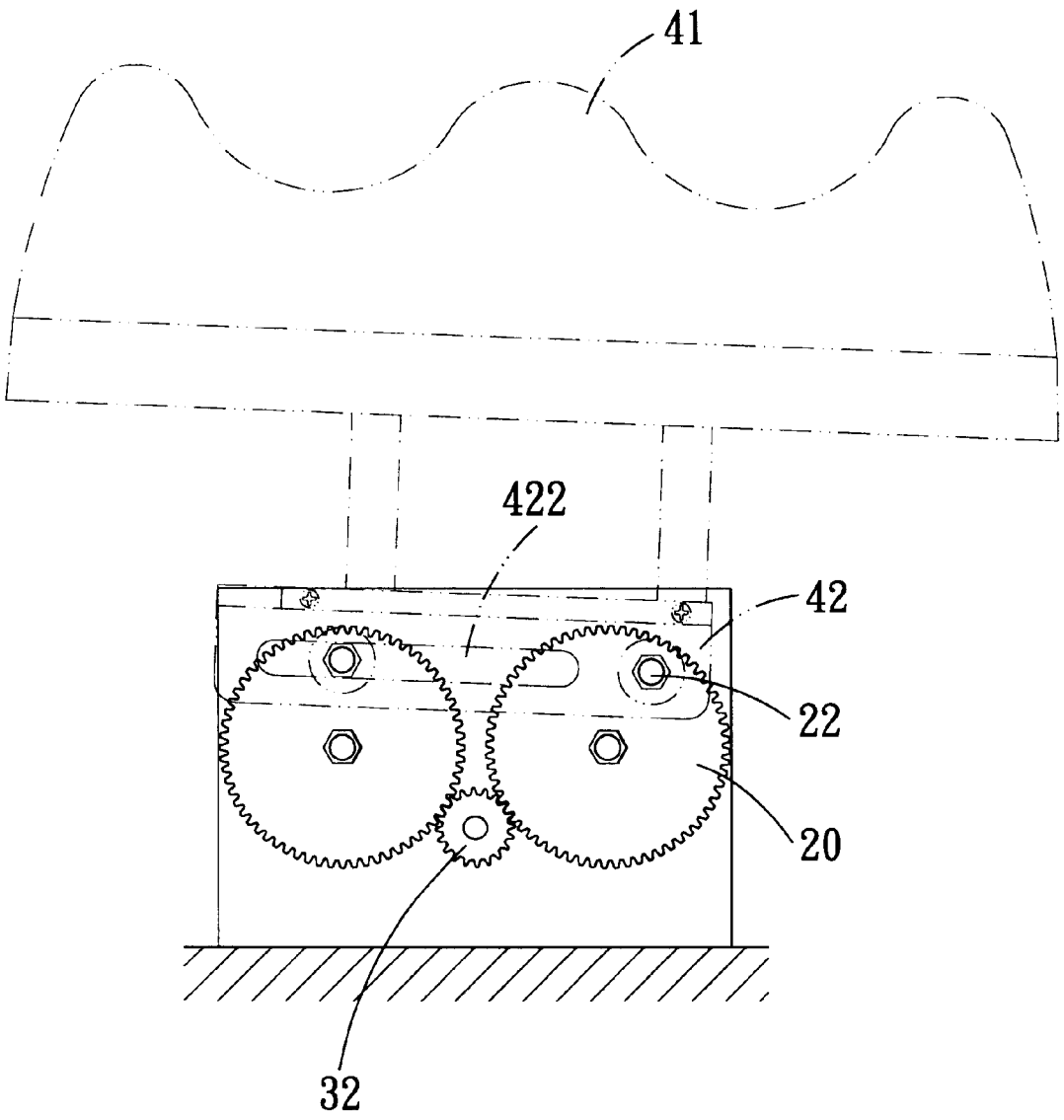
Figure 9:
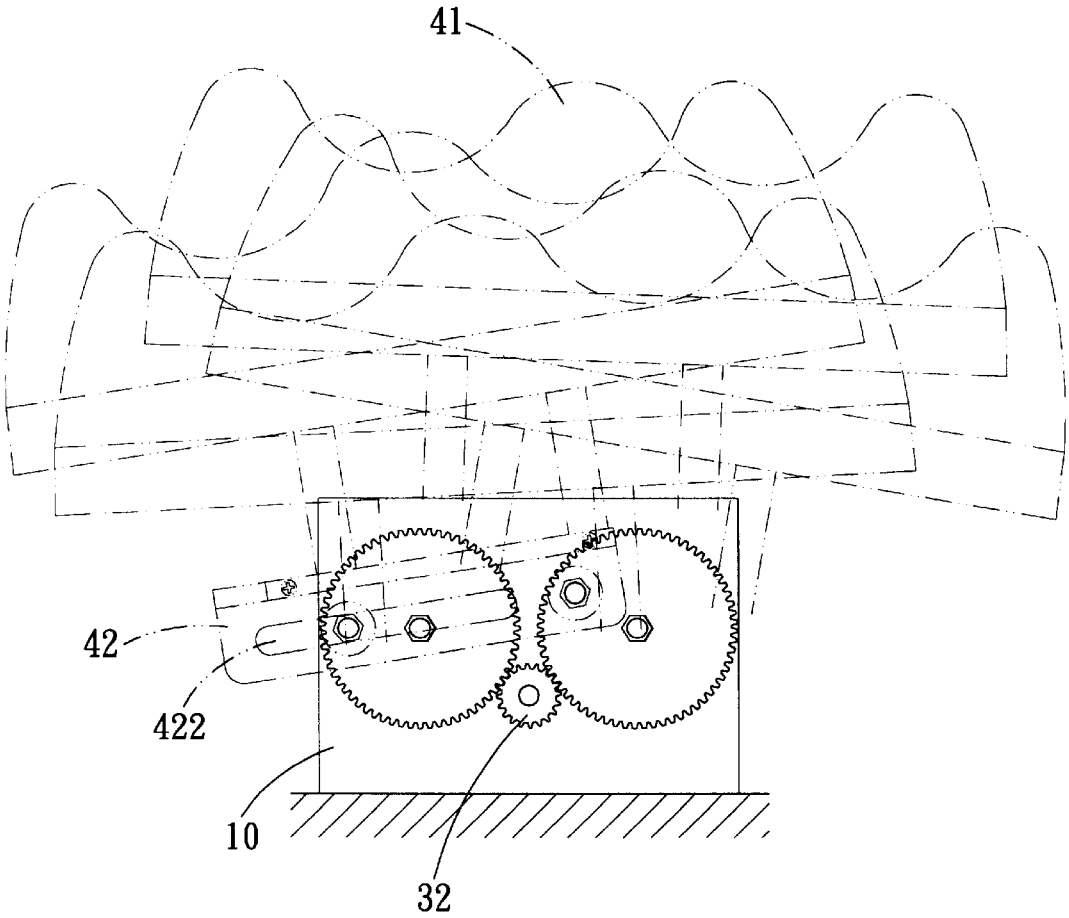

FIGS. 5 to 9 shows various positions of the support member 41 when the swing exercising device of the present invention is in use. The shaft 22 engaged with the hole 421 in the frame 42 rotates an end of the frame 42 in a circular motion, and the other shaft 22 in the slot 422 makes the other end of the frame 42 to move in an elliptical movement. By the two shafts 22, the support member 41 performs in different ways and this provides the user to enjoy changeable swing molds.

While we have shown and described the embodiment in accordance with the present invention, it should be clear to those skilled in the art that further embodiments may be made without departing from the scope of the present invention.

What is claimed is:

1. A swing exercising device comprising:

a base having holes defined therethrough;

two gears pivotably connected to an outside of the base and a shaft connected to each gear eccentrically;

a driving device having a driving gear engaged with the two gears, and a frame having a support member connected thereto and a hole and a slot respectively defined in the frame wherein one of the two shafts is engaged with the hole in the frame and the other shaft is movably retained in the slot.

2. The device as claimed in claim 1, wherein the driving gear is driven by a reduction device and a motor, the reduction device having a plurality of gears to reduce the rotational speed.

3. The device as claimed in claim 1, wherein two bushes are respectively received in the hole and the slot and mounted to the shafts.

* * * * *